US009182120B2

(12) United States Patent
Kim et al.

(10) Patent No.: US 9,182,120 B2
(45) Date of Patent: Nov. 10, 2015

(54) LOW-POLLUTION BURNING METHOD USING SYSTEM FOR INDIVIDUALLY CONTROLLING CO AND NOX

(71) Applicant: Global Standard Technology Co., Ltd., Gyeonggi-do (KR)

(72) Inventors: Jong Chul Kim, Gyeonggi-do (KR); Jong Kook Chung, Gyeonggi-do (KR); Sung Wook Lee, Gyeonggi-do (KR); Wan Gi Roh, Gyeonggi-do (KR); Sun Ho Kim, Gyeonggi-do (KR); Suk-Ho Kang, Gyeongsangnam-do (KR)

(73) Assignee: Global Standard Technology Co., Ltd., Gyeonggi-do (KR)

( * ) Notice: Subject to any disclaimer, the term of this patent is extended or adjusted under 35 U.S.C. 154(b) by 0 days.

(21) Appl. No.: 13/686,960

(22) Filed: Nov. 28, 2012

(65) Prior Publication Data

US 2014/0106282 A1 Apr. 17, 2014

(30) Foreign Application Priority Data

Oct. 16, 2012 (KR) ..... 10-2012-0114895

(51) Int. Cl.
*F23D 14/00* (2006.01)
*F23G 7/06* (2006.01)

(52) U.S. Cl.
CPC .. *F23G 7/065* (2013.01); *F23G 7/06* (2013.01)

(58) Field of Classification Search
CPC ..... F23G 7/06; F23G 7/065
USPC ..... 431/5
See application file for complete search history.

(56) References Cited

U.S. PATENT DOCUMENTS

| | | | | |
|---|---|---|---|---|
| 4,941,415 | A * | 7/1990 | Pope et al. | 110/235 |
| 5,322,026 | A * | 6/1994 | Bay, II | 110/235 |
| 6,494,711 | B1 | 12/2002 | Takemura et al. | |
| 6,682,342 | B2 | 1/2004 | Takemura et al. | |
| 6,736,635 | B1 | 5/2004 | Takemura et al. | |
| 6,796,794 | B2 | 9/2004 | Takemura et al. | |
| 6,969,250 | B1 * | 11/2005 | Kawamura et al. | 431/185 |
| 7,473,095 | B2 | 1/2009 | Gaur et al. | |
| 7,569,193 | B2 * | 8/2009 | Ferron et al. | 422/168 |
| 2002/0041836 | A1 | 4/2002 | Komai et al. | |

(Continued)

FOREIGN PATENT DOCUMENTS

| | | |
|---|---|---|
| JP | 54-162863 A | 12/1979 |
| JP | 05-026408 A | 2/1993 |

(Continued)

OTHER PUBLICATIONS

Lee, Hyun-Yong, "NOx Emission Characteristics of Premixed Air-staged Combustor using a Cyclone Flow", Master's thesis, Feb. 2008, Inha University Mechanical Engineering.

*Primary Examiner* — Kenneth Rinehart
*Assistant Examiner* — Gajanan M Prabhu
(74) *Attorney, Agent, or Firm* — IP Legal Services, LLC

(57) ABSTRACT

The disclosure relates to a waste gas purification method, and more particularly, to a waste gas burning method of reducing CO and NOx by burning waste gases using a system for individually controlling CO and NOx. In accordance with the disclosure, there is provided a low-pollution burning method using a system for individually controlling CO and NOx including a waste gas introduction and flame injection step; a first waste gas burning step; and a second waste gas burning step.

12 Claims, 9 Drawing Sheets

(56) References Cited

U.S. PATENT DOCUMENTS

| | | | | |
|---|---|---|---|---|
| 2003/0054299 | A1 | 3/2003 | Kawamura et al. | |
| 2004/0028590 | A1 | 2/2004 | Tsuji et al. | |
| 2004/0191142 | A1 | 9/2004 | Takemura et al. | |
| 2004/0261670 | A1 | 12/2004 | Dueck et al. | |
| 2005/0135984 | A1 | 6/2005 | Ferron et al. | |
| 2005/0271988 | A1 | 12/2005 | Komai et al. | |
| 2006/0141414 | A1* | 6/2006 | Harada et al. | 431/354 |
| 2006/0246385 | A1 | 11/2006 | Gaur et al. | |
| 2007/0160946 | A1 | 7/2007 | Komai et al. | |
| 2009/0010816 | A1 | 1/2009 | Ferron et al. | |
| 2009/0035709 | A1 | 2/2009 | Mennie et al. | |
| 2014/0056785 | A1* | 2/2014 | Tsukada et al. | 422/643 |

FOREIGN PATENT DOCUMENTS

| | | | |
|---|---|---|---|
| JP | 06-201105 | A | 7/1994 |
| JP | 07-310914 | A | 11/1995 |
| JP | 2001-193918 | A | 7/2001 |
| JP | 2007-519878 | A | 7/2007 |
| JP | 2007-218584 | A | 8/2007 |
| JP | 2007-263554 | A | 10/2007 |
| JP | 2008-541002 | A | 11/2008 |
| KR | 10-2000-0051186 | A | 8/2000 |
| KR | 10-2010-0048213 | A | 5/2010 |
| WO | 00/32990 | A1 | 6/2000 |
| WO | 20121120773 | A1 | 9/2012 |
| WO | WO 2012120773 | A1 * | 9/2012 |

* cited by examiner

LOW-POLLUTION BURNING METHOD USING SYSTEM FOR INDIVIDUALLY CONTROLLING CO AND NOX

CROSS-REFERENCE TO RELATED APPLICATION(S)

This application claims priority to Korean Patent Application No. 10-2012-0114895, filed on Oct. 16, 2012 in the Korean Intellectual Property Office, which is incorporated herein by reference in its entirety.

BACKGROUND OF THE INVENTION

1. Field of the Invention

Exemplary embodiments of the present invention relate to a waste gas purification method, and more particularly, to a waste gas burning method of reducing CO and NOx by burning waste gases using a system for individually controlling CO and NOx.

2. Description of the Related Art

In general, waste gases, which are generated in an industrial process such as a semiconductor or LCD (Liquid Crystal Display) manufacturing process or a chemical process, have highly toxic, explosive, and corrosive properties. Accordingly, the waste gases are released as they are into the atmosphere to allow environmental pollution to be caused. Therefore, a purification process should be necessarily performed to reduce an amount of noxious components contained in the waste gases below the allowable concentration.

As a method of processing the waste gases generated in the semiconductor manufacturing process or the like, there is a burning method of decomposing, reacting, or burning a pyrophoric gas with a hydrogen radical or the like in a high temperature combustion chamber, a wet method of dissolving a water-soluble gas in water while the water-soluble gas passes through the water stored in a water reservoir, or an adsorption method of purifying a toxic gas, which is not pyrophoric and soluble, in such a manner that the toxic gas is adsorbed onto an adsorbent by physical or chemical adsorption during passing through the adsorbent.

The burning method utilizes a combustion apparatus to burn the waste gases. There is, however, a problem in that, in the combustion apparatus of the related art, the waste gases generated in the semiconductor manufacturing process and $N_2$ gases used in a dry vacuum pump or the like are oxidized at a high temperature while being introduced into the combustion apparatus, thereby allowing large nitrogen oxides (NOx) to be rapidly generated.

Moreover, there is a problem that the waste gases are burned at a high temperature within the combustion chamber with the consequence that CO is introduced and generated due to incomplete combustion.

Furthermore, looking through combustion characteristics, a NOx concentration is increased by an increase in temperature within the combustion chamber as a CO concentration is decreased. Conversely, there is a problem in that a trade off relation occurs in which the CO concentration is increased as the NOx concentration is decreased.

SUMMARY OF THE INVENTION

Accordingly, the present invention is directed to a low-pollution burning method using a system for individually controlling CO and NOx that substantially obviates one or more problems due to limitations and disadvantages of the related art.

An object of the present invention is to provide a waste gas burning method of reducing CO and NOx by burning waste gases using a system for individually controlling CO and NOx.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

In accordance with an aspect of the present invention, a low-pollution burning method of processing a waste gas generated in an industrial process, such as a chemical process, a semiconductor manufacturing process, or an LCD manufacturing process, using a system for individually controlling CO and NOx includes a waste gas introduction and flame injection step of introducing the waste gas into a first combustion region and generating a flame by igniting a fuel gas in which a combustible gas and a support gas are pre-mixed; a first waste gas burning step of burning the waste gas in the first combustion region by the waste gas coming into contact with the flame arising from igniting the fuel gas in which the combustible gas and the support gas are pre-mixed; a second waste gas burning step of inducing complete combustion by burning unburned components (CO and $CH_4$), which remain in a waste gas moved to a second combustion region after going through the first waste gas burning step, together with a support gas, which is additionally introduced into the second combustion region, in the second combustion region; and a waste gas discharge step of discharging a waste gas purified through the second waste gas burning step to the outside, wherein the combustible gas is made of any one or more of LNG (liquefied natural gas), LPG (liquefied petroleum gas), and hydrogen gas, and the support gas is made of any one or more of air and $O_2$.

The generation of nitrogen oxide (NOx) may be suppressed by adjusting an amount of the support gas which is pre-mixed with the combustible gas at the first waste gas burning step.

The unburned components (CO and $CH_4$) may be removed and carbon monoxide (CO) may be removed by adjusting an amount of the support gas which is additionally introduced at the second waste gas burning step.

The waste gas may be burned in a state in which the support gas is pre-mixed so that an equivalence ratio ($\Phi$) of the pre-mixed fuel gas is set to satisfy the following range:

$$1.0 \leq \text{equivalence ratio } (\Phi) \leq 2.0.$$

A temperature (T) distribution of the second combustion region may be set to satisfy the following range:

$$600^\circ\text{ C.} \leq \text{temperature } (T) \text{ of second combustion region} \leq 800^\circ\text{ C.}$$

The low-pollution burning method may further include a third waste gas burning step of inducing complete combustion by burning unburned components, which remain in a waste gas even after going through the second waste gas burning step, together with a support gas, which is additionally introduced into a third combustion region, in the third combustion region.

The low-pollution burning method may further include a waste gas cooling step of cooling the purified waste gas before discharging the purified waste gas to the outside.

It is to be understood that both the foregoing general description and the following detailed description of the present invention are exemplary and explanatory and are intended to provide further explanation of the invention as claimed.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF EMBODIMENTS

Figure 1:
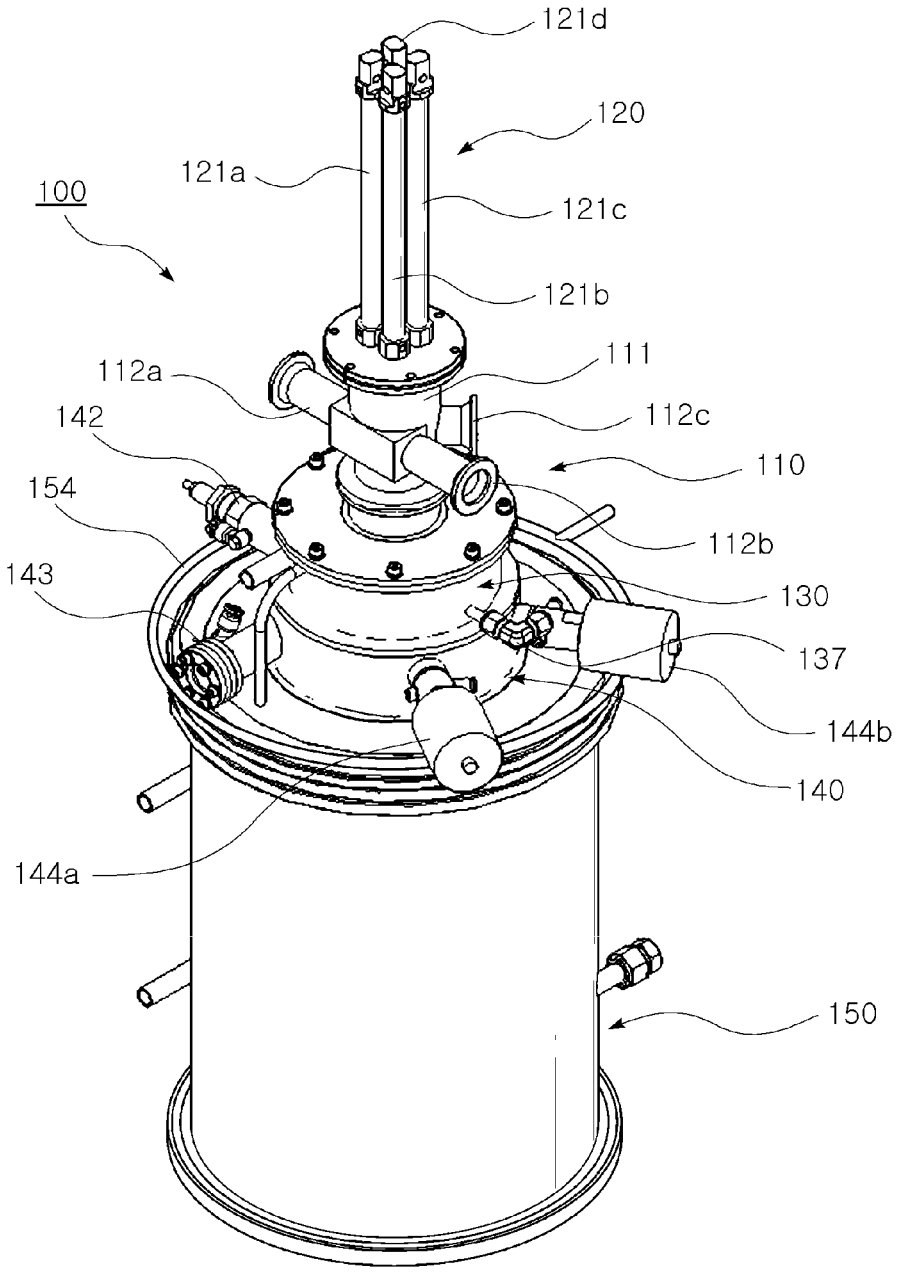
FIG. 1 is a perspective view illustrating a waste gas combustion apparatus according to an embodiment of the present invention.

Exemplary embodiments of the present invention will be described below in more detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. Throughout the disclosure, like reference numerals refer to like parts throughout the various figures and embodiments of the present invention. The drawings are not necessarily to scale and in some instances, proportions may have been exaggerated in order to clearly illustrate features of the embodiments.

Figure 2:
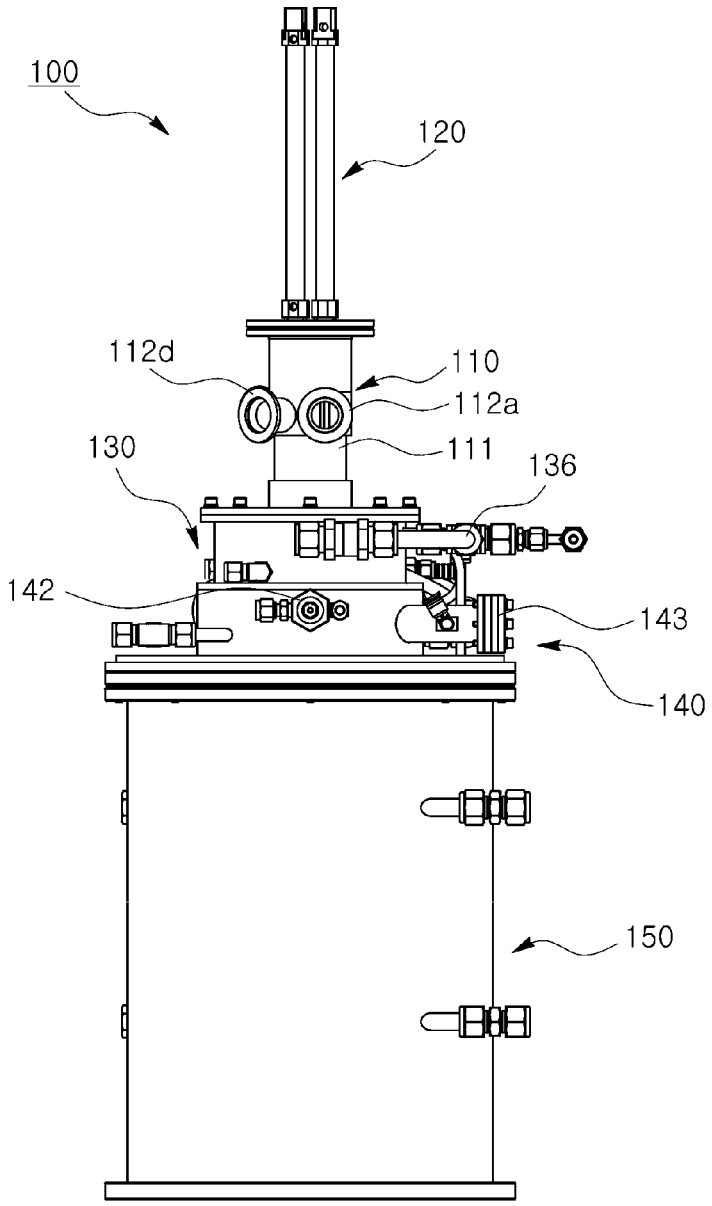
FIG. 2 is a side view of the waste gas combustion apparatus shown in FIG. 1.
Figure 3:
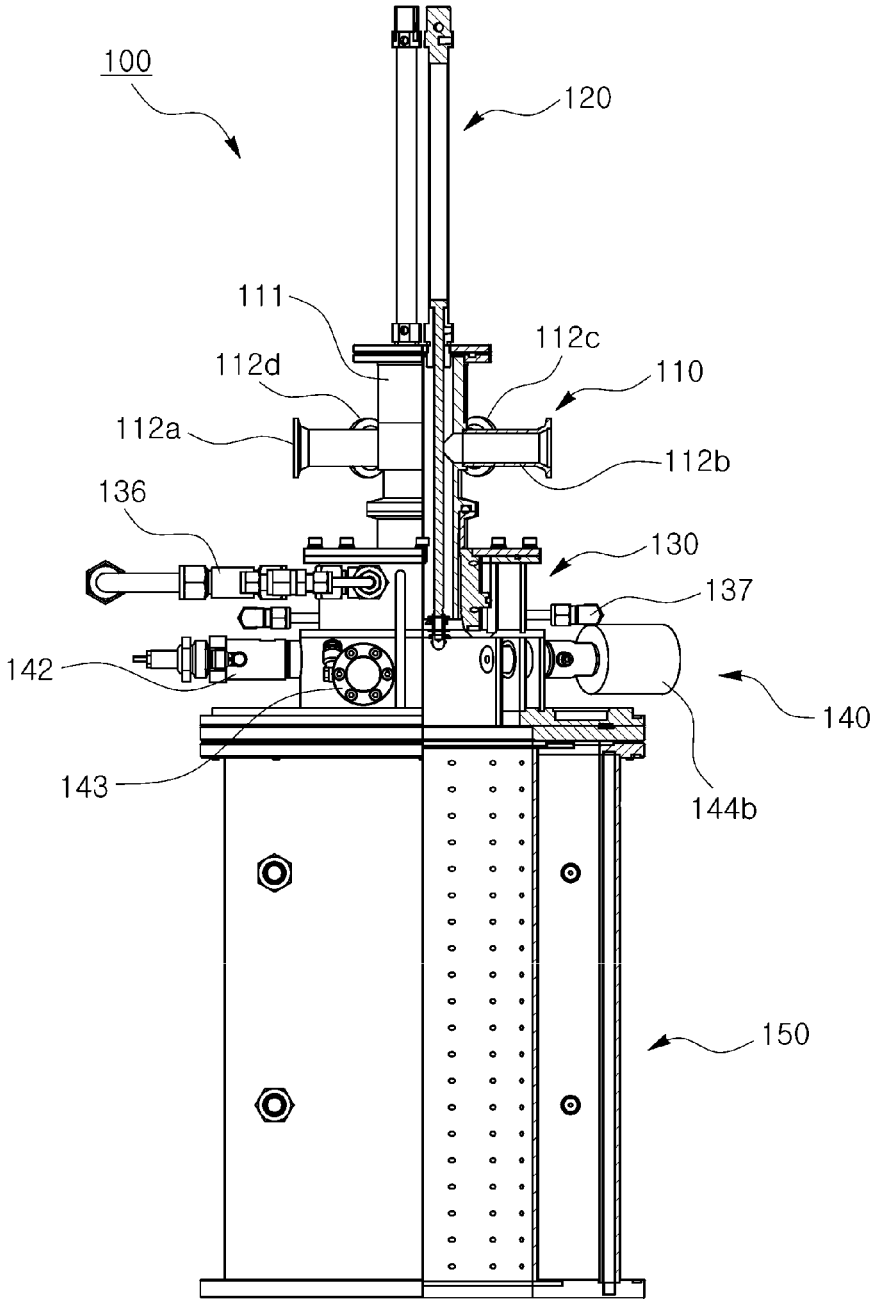
FIG. 3 is a partial cutaway side view of the waste gas combustion apparatus shown in FIG. 1.
Figure 4:
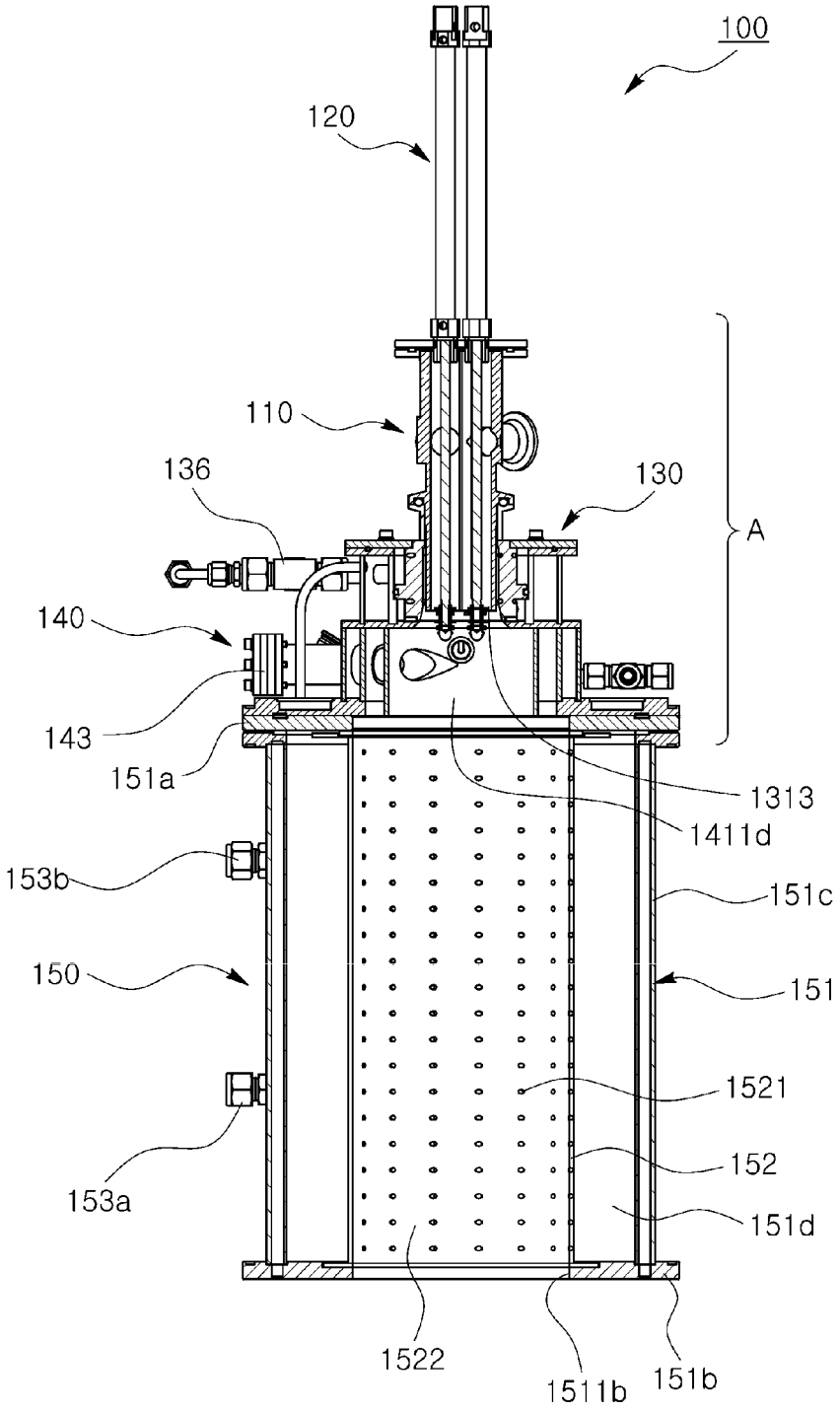
FIG. 4 is a longitudinal cross-sectional view of the waste gas combustion apparatus shown in FIG. 1.
Figure 5:
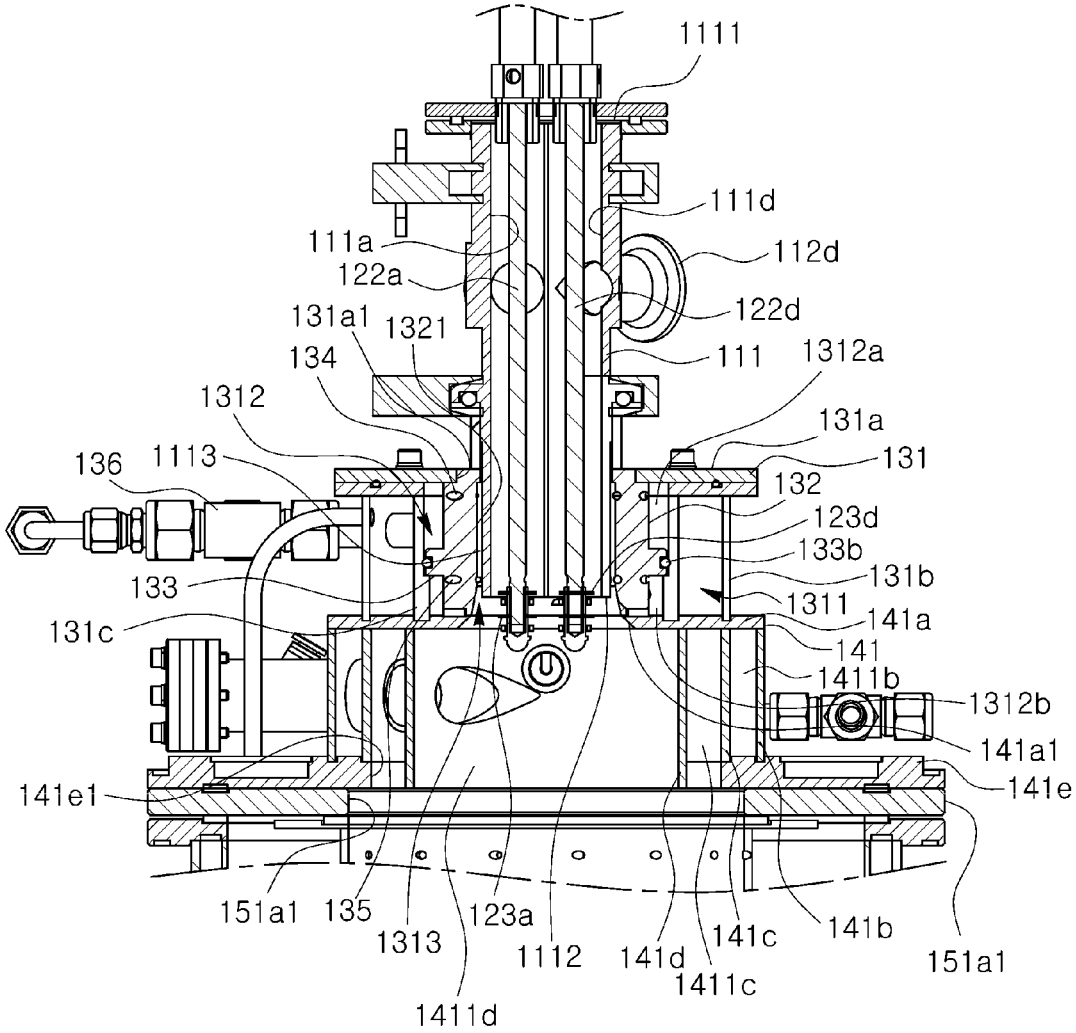
FIG. 5 is an enlarged cross-sectional view of portion "A" in FIG. 4.
Figure 6:
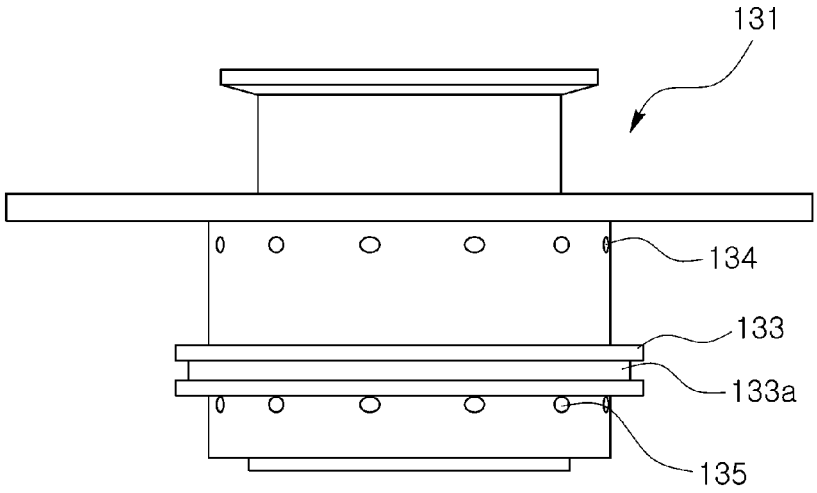
FIG. 6 is a side view of a gas nozzle member shown in FIG. 5.
Figure 7:
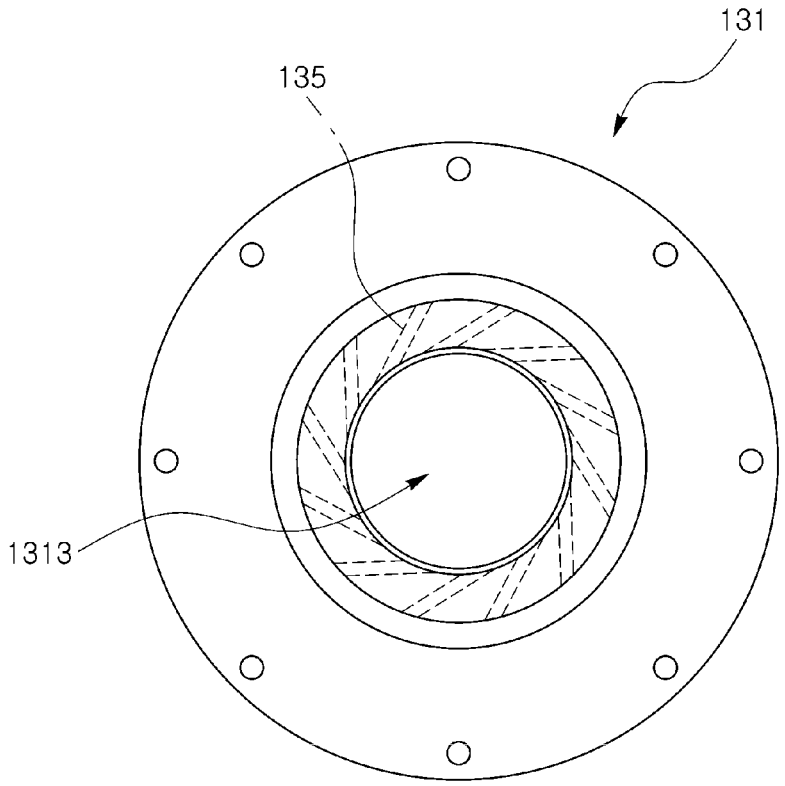
FIG. 7 is a top view for explaining a fuel gas supply structure of the waste gas combustion apparatus shown in FIG. 1.

FIG. 1 is a perspective view illustrating a waste gas combustion apparatus according to an embodiment of the present invention, FIG. 2 is a side view of the waste gas combustion apparatus shown in FIG. 1, FIG. 3 is a partial cutaway side view of the waste gas combustion apparatus shown in FIG. 1, and FIG. 4 is a longitudinal cross-sectional view of the waste gas combustion apparatus shown in FIG. 1. With reference to FIGS. 1 to 4, the waste gas combustion apparatus, which is designated by reference numeral 100, includes a waste gas supply unit 110, a by-product processing unit 120, a combustion gas supply unit 130, an ignition unit 140, and a body 150.

The waste gas supply unit 110 includes a guide pipe 111, and first to fourth injection pipes 112*a*, 112*b*, 112*c*, and 112*d*. The waste gas supply unit 110 supplies a combustion region defined within the waste gas combustion apparatus 100 with waste gases, which are a target to be treated, generated in a semiconductor manufacturing process, a chemical process, or the like.

Figure 8:
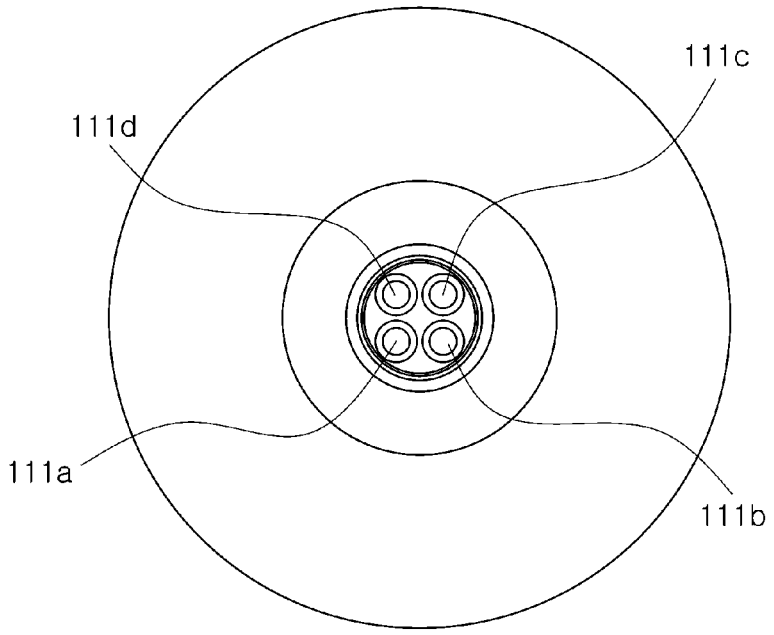
FIG. 8 is a top view for explaining a waste gas introduction structure of the waste gas combustion apparatus shown in FIG. 1.

The guide pipe 111 has a cylindrical shape which is elongated in an upward and downward direction. With reference to FIG. 8, the guide pipe 111 includes first to fourth waste gas guide passages 111*a*, 111*b*, 111*c*, and 111*d* of which each extends vertically therein and is opened at opposite ends thereof, and which are separated from one another. Each of the waste gas guide passages 111*a*, 111*b*, 111*c*, and 111*d* is individually formed for each type of waste gas to be introduced, so that it may be possible to solve a problem in that the waste gases are reacted with one another in the waste gas combustion apparatus.

The first to fourth injection pipes 112*a*, 112*b*, 112*c*, and 112*d* are arranged around the side of the guide pipe 111 along the circumferential direction thereof in the form of protruding in an outwardly radial direction. The first injection pipe 112*a* is connected to the first waste gas guide passage 111*a*, the second injection pipe 112*b* is connected to the second waste gas guide passage 111*b*, the third injection pipe 112*c* is connected to the third waste gas guide passage 111*c*, and the fourth injection pipe 112*d* is connected to the fourth waste gas guide passage 111*d*. The waste gases are introduced into the waste gas guide passages 111*a*, 111*b*, 111*c*, and 111*d* through the injection pipes 112*a*, 112*b*, 112*c*, and 112*d*, respectively.

The waste gas supply unit 110 has been described as including the four individual waste gas guide passages 111*a*, 111*b*, 111*c*, and 111*d*, and the four injection pipes 112*a*, 112*b*, 112*c*, and 112*d* which respectively correspond to the same in the present embodiment. However, unlike the above-mentioned configuration, three or less or five or more individual waste gas guide passages and injection pipes which respectively correspond to the same may be used depending on types of waste gases which are the target to be treated. Of course, one waste gas guide passage may also be used in which the waste gas guide passages are integrated with one another.

The by-product processing unit 120 includes first to fourth cylinders 121*a*, 121*b*, 121*c*, and 121*d*, and piston rods 122*a* and 122*d* (only two piston rods being shown in the drawings) provided to respectively correspond to the same. The by-product processing unit 120 serves to remove powders (dust powders) which are fixed on inner walls of the respective waste gas guide passages 111*a*, 111*b*, 111*c*, and 111*d* of the waste gas supply unit 110 during a combustion process.

The first to fourth cylinders 121*a*, 121*b*, 121*c*, and 121*d* are coupled to an upper end 1111 of the guide pipe 111 of the waste gas supply unit 110. The first cylinder 121*a* is located to correspond to the first waste gas guide passage 111*a*, the second cylinder 121*b* is located to correspond to the second waste gas guide passage 111*b*, the third cylinder 121*c* is located to correspond to the third waste gas guide passage 111*c*, and the fourth cylinder 121*d* is located to correspond to the fourth waste gas guide passage 111*d*. The piston rods 122*a* and 122*d* provided to correspond to the respective cylinders 121*a*, 121*b*, 121*c*, and 121*d* are moved (perform linear and/or rotational movement) within the corresponding waste gas guide passages 111*a*, 111*b*, 111*c*, and 111*d*, respectively. The piston rods 122*a* and 122*d* are respectively coupled, at ends thereof, with removal members 123*a* and 123*d* which are able to scrub and remove the powders fixed on the inner walls of the waste gas guide passages 111*a*, 111*b*, 111*c*, and 111*d*.

Although the by-product processing unit 120 has been described as removing the powders fixed on the inner walls of the waste gas guide passages during the movement of the piston rods in the present embodiment, it may also be possible to remove the fixed powders by purging a heated nitrogen gas ($N_2$) and the like to each waste gas guide passage, other than the above-mentioned configuration.

The combustion gas supply unit 130 includes a case 131, a gas nozzle member 132, a pre-mixed fuel gas injection portion 136, and a support gas injection portion 137. The combustion gas supply unit 130 serves to supply fuel gases and support gases required for the combustion of the waste gases.

The case 131 has a hollow cylindrical shape and is located at an upper portion of the ignition unit 140. The case 131 includes an upper wall 131*a*, an outer side wall 131*b*, and an inner side wall 131*c*. The upper wall 131*a* is formed, at a central portion thereof, with a through hole 131*a*1 through which the gas nozzle member 132 passes. The outer side wall 131*b* extends downwards from the upper wall 131*a* so that a lower end of the outer side wall 131*b* is coupled to an upper end of the ignition unit 140. The inner side wall 131*c* extends downwards from the upper wall 131*a* so that a lower end of the inner side wall 131*c* is coupled to the upper end of the ignition unit 140. The inner side wall 131*c* is located at the inside of the outer side wall 131*b*. A separate space 1311 is defined between the outer side wall 131*b* and the inner side wall 131*c*. This space 1311 functions as a cooling water circulation space.

The gas nozzle member 132 has a cylindrical shape which extends in an upward and downward direction. The gas nozzle member 132 is provided therein with an inner space 1313, which extends along a center line thereof in an upward and downward direction and passes through the gas nozzle member 132. This inner space 1313 functions as a first combustion region which is a space where a flame is formed. The gas nozzle member 132 is accommodated, at a lower portion thereof, in an inner space of the inner side wall 131*c* while protruding, at an upper portion thereof, upwards of the upper wall 131*a* via the through hole 131*a*1 of the upper wall 131*a*. The gas nozzle member 132 is abutted, at a lower end thereof, onto the upper end of the ignition unit 140. The gas nozzle member 132 is provided, at an outer wall thereof, with separate flanges 133 of which each has an annular shape and protrudes in an outwardly radial direction. Each of the separate flanges 133 is provided with an annular groove 133*a* formed along the separate flange 133. The annular groove 133*a* is fitted with a seal ring 133*b*. The seal ring 133*b* comes into contact with the inner side wall 131*c* to allow a space 1312 to be defined between the inner side wall 131*c* and the outer wall of the gas nozzle member 132. The space 1312 is divided into a first upper gas space 1312*a* and *a* second lower gas space 1312*b*. The outer wall of the gas nozzle member 132 is provided with a plurality of pre-mixed fuel gas nozzles 134 to communicate the first gas space 1312*a* with the inner space 1313 of the gas nozzle member 132, and a plurality of support gas nozzles 135 to communicate the second gas space 1312*b* with the inner space 1313 of the gas nozzle member 132. Pre-mixed fuel gases are supplied to the inner space 1313 of the gas nozzle member 132 through the plural pre-mixed fuel gas nozzles 134. The plural pre-mixed fuel gas nozzles 134 are disposed to be inclined toward one side with respect to the radial direction. Accordingly, the pre-mixed fuel gases are rotatably supplied when being introduced into the inner space 1313 of the gas nozzle member 132 through the plural pre-mixed fuel gas nozzles 134, thereby being smoothly mixed. Consequently, the generation of thermal $NO_x$ and CO may be reduced. The plural support gas nozzles 135 are disposed to be inclined toward one side with respect to the radial direction. Accordingly, the support gases are rotatably supplied when being introduced into the inner space 1313 of the gas nozzle member 132, thereby allowing the diffusion combustion to be properly carried out and the temperature distribution to be uniformly maintained. The guide pipe 111 of the waste gas supply unit 110 is inserted and accommodated, at a lower portion thereof, in the inner space 1313 of the gas nozzle member 132. The guide pipe 111 has a lower end 1112 which is located beneath the support gas nozzles 135.

The pre-mixed fuel gas injection portion 136 passes through the outer side wall 131*b* and inner side wall 131*c* of the case 131 to be connected with the first gas space 1312*a*. The fuel gas injection portion 136 produces the fuel gases in a state of being diluted by mixing the combustible gases with the support gases, and then injects the pre-mixed fuel gases, which are produced, into the first gas space 1312*a*. There may be utilized a liquefied natural gas, a liquefied petroleum gas, a hydrogen gas, and the like, as the fuel gases.

The support gas injection portion 137 passes through the outer side wall 131*b* and inner side wall 131*c* of the case 131 to be connected with the second gas space 1312*b*. The support gas injection portion 137 injects the support gases such as an oxygen gas into the second gas space 1312*b*.

The ignition unit 140 includes a case 141, an ignition device 142, a display window 143, and first and second combustion detection sensors 144*a* and 144*b*.

The case 141 has a substantially hollow cylindrical shape and is located at an upper portion of the body 150. The case 141 includes an upper wall 141*a*, an outer side wall 141*b*, an inner side wall 141*c*, a flame guide wall 141*d*, and a bottom plate 141*e* which faces the upper wall 141*a* and is formed, at a central portion thereof, with a through hole 141*e*1. The upper wall 141*a* is formed, at a central portion thereof, with a through hole 141*a*1 which is communicated with the inner space 1313 of the gas nozzle member 132. The outer side wall 141*b* extends downwards from the upper wall 141*a* so that a lower end of the outer side wall 141*b* is coupled to the bottom plate 141*e*. The inner side wall 141*c* extends downwards from the upper wall 141*a* so that a lower end of the inner side wall 141*c* is coupled to the bottom plate 141*e*. The inner side wall 141*c* is located at the inside of the outer side wall 141*b*. A separate space 1411 is defined between the outer side wall 141*b* and the inner side wall 141*c*. The flame guide wall 141*d* extends downwards from the upper wall 141*a* so that a lower end of the flame guide wall 141*d* is located in the through hole 141*e*1 formed at the bottom plate 141*e*. A space 1411*c* is defined between the flame guide wall 141*d* and the inner side wall 141*c*. The flame guide wall 141*d* is provided therein with a space 1411*d*, which is connected with the inner space 1313 of the gas nozzle member 132, an inner portion of the body 150, and the space 1411*c* between the flame guide wall 141*d* and the inner side wall 141*c*. This space 1411*d* functions as a second combustion region which is a space where the flame is diffused. In addition, a first air inlet portion 154 is mounted around a case member 151 to be later and supplies air or $O_2$ to the second combustion region The flame guide wall 141*d* enables the flame generated in the first combustion region 1313 to be excessively swirled so as to prevent the contact between the flame and the waste gas from being reduced. Furthermore, the flame guide wall 141*d* enables the flame to be properly diffused and to smoothly come into contact with the waste gas, thereby resulting in high processing efficiency of the waste gas.

The ignition device 142 passes through the outer side wall 141*b*, inner side wall 141*c*, and flame guide wall 141*d* of the case 141 to be connected with the space within the flame guide wall 141*d*. The ignition device 142 supplies an ignition source to the space within the flame guide wall 141*d*. The ignition device 142 includes an ignition plug and supplies CDA (Compressed Dry Air) to maintain a burner part in a dry state. When moisture is created in the burner part, powder fixation is activated.

The display window 143 passes through the outer side wall 141*b*, inner side wall 141*c*, and flame guide wall 141*d* of the case 141 to be connected with the space within the flame guide wall 141*d*. The display window 143 allows an ignition phenomenon and a combustion phenomenon to be visually observed. The display window 143 has a fuzzy function because of being affected by the high temperature.

Each of the first and second combustion detection sensors 144*a* and 144*b* passes through the outer side wall 141*b*, inner side wall 141*c*, and flame guide wall 141*d* of the case 141 to be connected with the space within the flame guide wall 141*d*. The first and second combustion detection sensors 144*a* and 144*b* detect the flames generated in the first and second combustion regions 1313*a* and 1313*b*.

The bottom plate 141*e* is provided therein with a cooling water circulation space formed to enclose the through hole 141*e*1.

The body 150 includes an outer case member 151, an inner wall member 152, and a plurality of air inlet portions 153*a* and 153*b*.

The case member 151 has a substantially hollow cylindrical shape and includes an upper wall 151*a*, a bottom plate 151*b*, and a side wall 151*c*. The upper wall 151*a* is coupled to a lower surface of the bottom plate 141*e* of the ignition unit 140. The upper wall 151*a* is provided, at a central portion thereof, with a through hole 151*a*1. The through hole 151*a*1 is formed larger than the through hole 141*e*1 of the bottom plate 141*e* of the ignition unit 140. The bottom plate 151*b* faces the upper wall 151*a* and is provided, at a central portion thereof, with a through hole 1511*b*. The side wall 151*c* extends between the upper wall 151*a* and the bottom plate 151*b*.

The inner wall member 152 has a hollow cylindrical shape which is opened at opposite ends thereof, and is coupled within the case member 151. The opened upper end of the inner wall member 152 is connected to the through hole 151*a*1 of the upper wall 151*a*, whereas the opened lower end of the inner wall member 152 is connected to the through hole 1511*b* of the bottom plate 151*b*. The inner wall member 152 is provided, at a wall thereof, with a plurality of holes 1521 to communicate inner and outer portions of the inner wall member 152. A space of the inner portion of the inner wall member 152 defines a third combustion region 1522.

The plural air inlet portions 153*a* and 153*b*, which are second air inlet portions, are mounted to the case member 151 and introduce outdoor air into the case member 151. The air, which is introduced through the second air inlet portions 153*a* and 153*b*, is supplied to the third combustion region 1522 so as to uniformly distribute heat generated in the third combustion region 1522, thereby reducing the generation of thermal $NO_x$.

Although not shown, circulating water or the like flows around along the wall surface of the inner wall member 152 to flow downwards, and thus it may also be possible to prevent the fixation of the powders created during the combustion of the waste gases.

Hereinafter, an operation of the above-mentioned embodiment will be described with reference to FIGS. 1 to 9.

Figure 9:
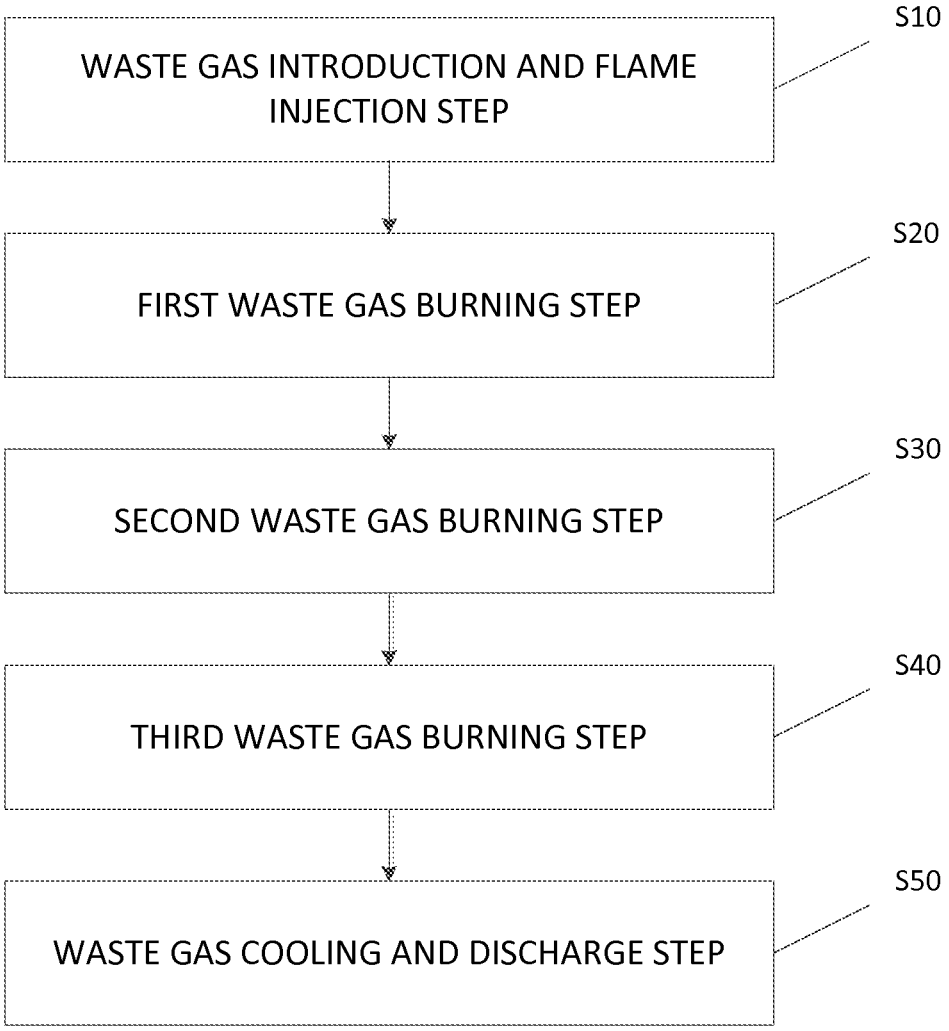
FIG. 9 is a process flow chart illustrating a waste gas burning method in order of process.

FIG. 9 is a process flow chart illustrating a waste gas burning method according to an embodiment of the present invention in order of process. Referring to FIG. 9, the burning method according to the embodiment of the present invention includes a waste gas introduction and flame injection step (S10), a first waste gas burning step (S20), a second waste gas burning step (S30), a third waste gas burning step (S40), and a waste gas cooling and discharge step (S50).

First, at the waste gas introduction and flame injection step (S10), the waste gases generated in the industrial process, such as the chemical process, the semiconductor manufacturing process, or the LCD manufacturing process, and $N_2$ gases used in a dry vacuum pump or the like are individually supplied to the inner space 1313 of the gas nozzle member 132, which is the first combustion region, through the respective waste gas guide passages 111*a*, 111*b*, 111*c*, and 111*d* formed at the guide pipe 111 of the waste gas supply unit 110, depending on the types of waste gases. At the same time, the pre-mixed fuel gases are rotatably supplied when being introduced into the inner space 1313 of the gas nozzle member 132 through the plural pre-mixed fuel gas nozzles 134, thereby being smoothly mixed. Moreover, the ignition device 142 supplies the ignition source to the space within the flame guide wall 141*d*, and generates the flame in the first combustion region.

Subsequently, the first waste gas burning step (S20) is a step of burning the waste gas, which is individually supplied through each of the waste gas guide passages 111*a*, 111*b*, 111*c*, and 111*d*, in a fuel excess state in which a fuel is rich and air is insufficient by the flame in the first combustion region. That is, the waste gas is rich-burned in a state in which a mixing amount of the fuel and the air is adjusted and an equivalence ratio (Φ) to be described later is greater than 1, with the consequence that the generation NOx is suppressed to be minimized. Specifically, the equivalence ratio (Φ) may be set to satisfy the following range.

$$1.0 \leq \text{equivalence ratio } (\Phi) \leq 2.0$$

Furthermore, the equivalence ratio (Φ) may be set to satisfy the following range, thereby enabling the generation NOx to be further effectively suppressed.

$$1.2 \leq \text{equivalence ratio } (\Phi) \leq 2.0$$

Through the first waste gas burning step (S20), an amount of nitrogen oxide (NOx), which may be generated in the waste gas combustion process, may be suppressed at a maximum in such a manner as to decrease an $O_2$ concentration and incompletely burn the waste gas in the first combustion region.

For reference, a formula for the equivalence ratio is defined as follows.

$$\Phi=(F/A)_{act}/(F/A)_{ideal} \text{ (}F\text{: number of moles of a fuel, } A\text{: number of moles of oxygen)}$$

where, $(F/A)_{act}$ is an actual reaction combustion ratio, and $(F/A)_{ideal}$ is an ideal combustion ratio by which contaminants are not generated. For example, in a case where the combustible gas is LNG (liquefied natural gas), if the LNG is 10 lmp and the $O_2$ is 15 lmp, the equivalence ratio is $\Phi=(F/A)_{act}/(EVA)_{ideal}=1.33$. In this case, diluted air is rich-burned.

Next, the second waste gas burning step (S30) is a step of burning a waste gas, which goes through the first waste gas burning step, in the second combustion region. Specifically, the second waste gas burning step (S30) refers to a step of reducing carbon monoxide (CO) by completely burning unburned components (CO and $CH_4$), which are incompletely burned and remain in the first combustion region, in the second combustion region 1411*d*. For this reason, the support gas (air or $O_2$) is additionally introduced through the first air inlet portion 154 into the second combustion region and the temperature distribution to be uniformly maintained through the proper diffusion combustion. In this case, the temperature (T) distribution of the second combustion region may be set to satisfy the following range so as to be maintained less than the generation temperature of the nitrogen oxide (NOx) and completely burn the unburned components (CO and $CH_4$).

600° C.≤temperature (*T*) of second combustion region≤800° C.

Furthermore, the temperature (T) distribution of the second combustion region may be set to satisfy the following range, thereby enabling the unburned components (CO and $CH_4$) to be completely burned more effectively.

700° C.≤temperature (*T*) of second combustion region≤800° C.

Through the second waste gas burning step (S30), the support gas is introduced into the second combustion region and the unburned components, which are incompletely burned, are induced to be completely burned, with the consequence that an amount of carbon monoxide (CO) may be suppressed at a maximum.

Subsequently, the third waste gas burning step (S40) is a step of burning unburned components which remain even after going through the second waste gas burning step. Specifically, the third waste gas burning step (S40) refers to a step of thirdly burning the waste gas in order to remove the unburned components which remain even after going through the second waste gas burning step (S30) depending on an amount of the waste gas introduced into the waste gas combustion apparatus. For this reason, air or $O_2$ is introduced through the plural second air inlet portion 153*a* and 153*b* into the third combustion region and the unburned components are completely burned. As a result, the carbon monoxide (CO) may be mostly removed.

Lastly, the waste gas cooling and discharge step (S50) refers to a step in which the waste gas where contaminants are mostly removed by being purified during the third waste gas burning step is cooled by cooling water introduced through a cooling water inlet pipe and is discharged through the through hole 1511*b* formed on the bottom plate 151*b* to the outside.

Eventually, the low-pollution burning method is disclosed in which the generation of the nitrogen oxide (NOx) is suppressed at a maximum in the first combustion region, and the generation of the carbon monoxide (CO) is suppressed in the second and third combustion regions, with the consequence that the generation of the CO and NOx is individually suppressed.

In accordance with the present invention, the above-mentioned objects may be all achieved.

Specifically, the generation of nitrogen oxide (NOx) may be suppressed at a maximum by burning a waste gas using mixing characteristics of a fuel and air at a first waste gas burning step.

Unburned components (CO and $CH_4$) of the waste gas are burned together with the supplied air or $O_2$ and complete combustion is induced at subsequent second and third waste gas burning steps, thereby enabling the carbon monoxide (CO) to be reduced to be minimized.

As a result, amounts of carbon monoxide (CO) and nitrogen oxide (NOx), which are finally discharge to the outside, may be reduced at a maximum by individually controlling CO and NOx.

Although the present invention has been described with respect to the illustrative embodiments, it will be apparent to those skilled in the art that various variations and modifications may be made without departing from the spirit and scope of the invention as defined in the following claims.

What is claimed is:

1. A low-pollution burning method of processing a waste gas generated in an industrial process, using a system for individually controlling CO and NOx, the low-pollution burning method comprising:

a waste gas introduction and flame injection step of introducing the waste gas into a first combustion region and generating a flame by igniting a fuel gas in which a combustible gas and a support gas are pre-mixed;

a first waste gas burning step of burning the waste gas in the first combustion region by the waste gas coming into contact with the flame arising from igniting the fuel gas in which the combustible gas and the support gas are pre-mixed, wherein an equivalence ratio of the pre-mixed fuel gas is set to such a ratio that the waste gas is rich-burned in the first combustion region;

a second waste gas burning step of inducing complete combustion by burning incomplete burned components comprising CO and $CH_4$, which remain in a waste gas moved to a second combustion region after going through the first waste gas burning step, together with a support gas, which is additionally introduced into the second combustion region, in the second combustion region, wherein a temperature (T) distribution of the second combustion region is maintained less than a generation temperature of NOx;

a third waste gas burning step of inducing complete combustion by burning the incomplete burned components which remain in a waste gas even after going through the second waste gas burning step, together with a support gas, which is additionally introduced into a third combustion region, in the third combustion region, wherein the second combustion region is surrounded by a flame guide wall that extends downwards from an upper wall of the second combustion region to a through hole of a lower wall of the second combustion region that connects to the third combustion region; and a waste gas discharge step of discharging a waste gas purified through the third waste gas burning step to the outside, wherein the combustible gas is made of any one or more of LNG (liquefied natural gas), LPG (liquefied petroleum gas), and hydrogen gas, and the support gas is made of any one or more of air and $O_2$; and wherein the third combustion region is defined by an inner wall member positioned in an outer case member, wherein (i) the inner wall member has a hollow cylindrical shape being opened at opposite ends, and is connected to the second combustion region such that a waste gas discharged from the second combustion region passes through along a z-axis direction of the inner wall member, (ii) air is provided into a space region between the outer case member and the inner wall member, through at least one air inlet portion, and (iii) a side wall of the inner wall member includes a plurality of holes for inletting the air which is provided through the at least one air inlet portion such that heat generated in the third combustion region is uniformly distributed in the third combustion region.

2. The low-pollution burning method according to claim 1, wherein the generation of nitrogen oxide (NOx) is suppressed by adjusting an amount of the support gas which is pre-mixed with the combustible gas at the first waste gas burning step.

3. The low-pollution burning method according to claim 1, wherein the incomplete burned components comprising the CO and $CH_4$ are removed and carbon monoxide (CO) is removed by adjusting an amount of the support gas which is additionally introduced at the second waste gas burning step.

4. The low-pollution burning method according to claim 1, wherein the waste gas is burned in a state in which the support gas is pre-mixed so that the equivalence ratio (Φ) of the pre-mixed fuel gas is set to satisfy the following range:

$$1.0 \leq \text{equivalence ratio } (\Phi) \leq 2.0.$$

5. The low-pollution burning method according to claim 4, wherein the temperature (T) distribution of the second combustion region is set to satisfy the following range:

600° C. temperature (T) of second combustion region 800° C.

6. The low-pollution burning method according to claim 1, further comprising:

a waste gas cooling step of cooling the purified waste gas before discharging the purified waste gas to the outside.

7. The low-pollution burning method according to claim 1, wherein the industrial process includes at least one of a chemical process, a semiconductor manufacturing process, and an LCD manufacturing process.

8. The low-pollution burning method according to claim 1, wherein:

the outer case member has a hollow cylindrical shape; and the inner wall member and the outer case member are coaxial.

9. The low-pollution burning method according to claim 1, wherein the at least one air inlet portion is configured to provide the air through the side wall of the outer case member.

10. The low-pollution burning method according to claim 1, wherein the pre-mixed fuel gas is introduced in the first combustion region through a plurality of nozzles which are disposed to be inclined toward one side with respect to a radial direction such that the pre-mixed fuel gases are rotated in the first combustion region.

11. The low-pollution burning method according to claim 1, wherein the waste gas is burned in a state in which the support gas is pre-mixed so that the equivalence ratio (Φ) of the pre-mixed fuel gas is set to satisfy the following range:

$$1.2 \text{ equivalence ratio } (\Phi) \leq 2.0.$$

12. The low-pollution burning method according to claim 1, wherein a diameter of the second combustion region is greater than a diameter of the first combustion region and less than a diameter of the third combustion region.

* * * * *